US006695498B2

(12) United States Patent
Kinley et al.

(10) Patent No.: US 6,695,498 B2
(45) Date of Patent: Feb. 24, 2004

(54) PRINTER COMPACT COIL WINDING SYSTEM

(75) Inventors: John Stanley Kinley, Costa Mesa, CA (US); Gordon B. Barrus, San Juan, CA (US)

(73) Assignee: Printronix, Inc., Irvine, CA (US)

( * ) Notice: Subject to any disclaimer, the term of this patent is extended or adjusted under 35 U.S.C. 154(b) by 15 days.

(21) Appl. No.: 10/008,908

(22) Filed: Dec. 6, 2001

(65) Prior Publication Data

US 2003/0051616 A1 Mar. 20, 2003

Related U.S. Application Data

(60) Provisional application No. 60/323,458, filed on Sep. 18, 2001.

(51) Int. Cl.[7] ..... B41J 19/30

(52) U.S. Cl. ..... 400/322; 700/124.01; 101/93.15; 335/299; 310/179

(58) Field of Search ..... 335/299; 400/320, 400/322, 347, 124.01; 19/93.15, 93.16; 310/179

(56) References Cited

U.S. PATENT DOCUMENTS 4,295,111 A * 10/1981 Frosch et al. ..... 335/256
4,441,830 A * 4/1984 Italiano ..... 400/124.17
4,509,564 A * 4/1985 Sedgewick ..... 140/92.2
5,204,650 A * 4/1993 Nemoto ..... 335/216
5,384,448 A * 1/1995 Kubasko ..... 219/209
5,743,665 A * 4/1998 Ryan et al. ..... 400/323
5,857,787 A * 1/1999 Ryan ..... 400/322
6,000,330 A * 12/1999 Farb et al. ..... 101/93.04
6,089,769 A * 7/2000 Farb ..... 400/248
6,478,487 B1 * 11/2002 Jou et al. ..... 400/240

* cited by examiner

*Primary Examiner*—Andrew H. Hirshfeld
*Assistant Examiner*—Dave A. Ghatt
(74) *Attorney, Agent, or Firm*—MacPherson Kwok Chen & Held LLP

(57) ABSTRACT

An impact printer having one or multiple lines of hammers on a hammerbank for impacting a print ribbon against a print media after release by one or more electrically energized coils in a magnetic circuit with one or more pole pieces retaining the hammers prior to impact. One or more of the coils has a spaced winding thereby allowing filling of the spaced winding during return winding. Another embodiment utilizes a longitudinal return from an initial winding which can be formed with multiple layers or multiple overlappings of the longitudinal return. The foregoing minimizes a first dimension while having controlled wire crossing resulting in expansion in a second dimension, thereby allowing compaction of magnetic circuits in the first dimension.

16 Claims, 13 Drawing Sheets

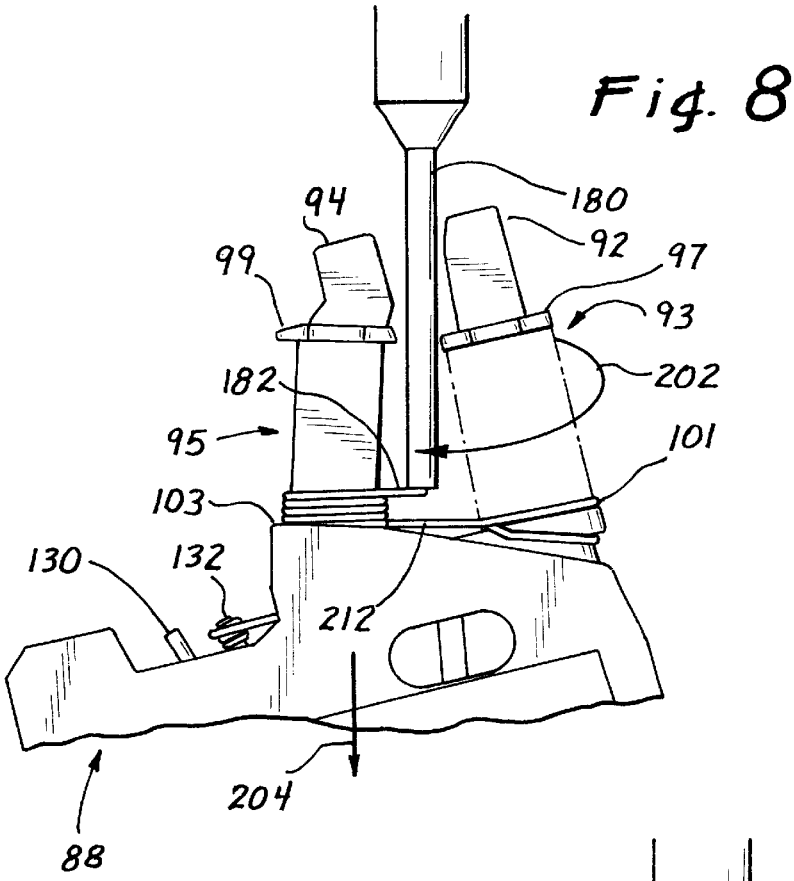
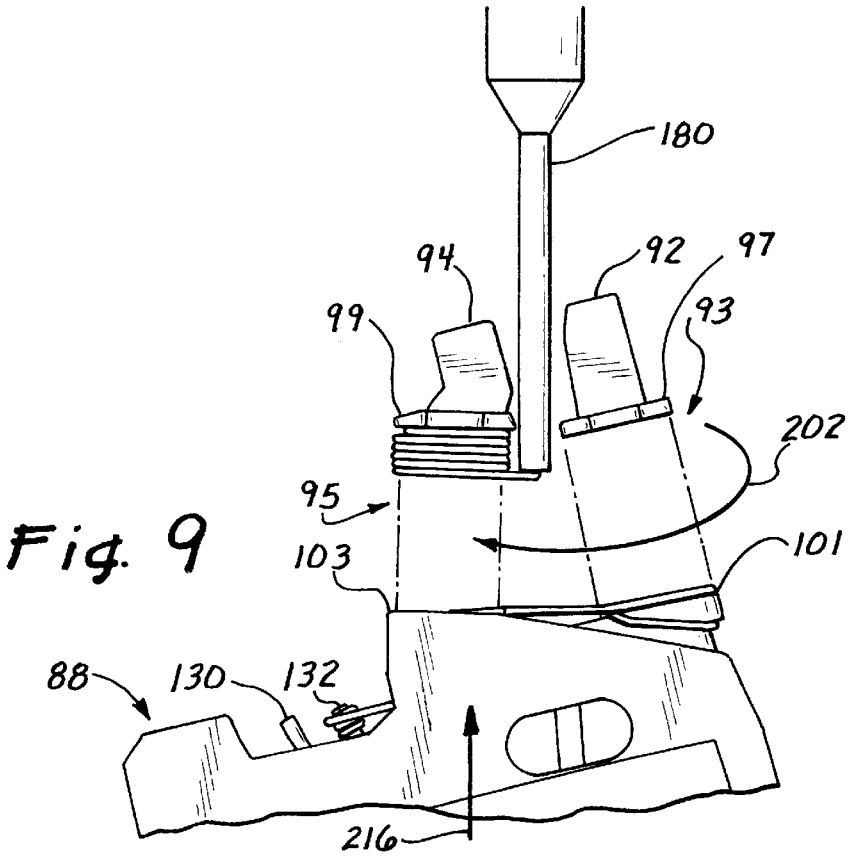
Fig. 9

PRINTER COMPACT COIL WINDING SYSTEM

This application claims the benefit of U.S. Provisional Application Ser. No. 60/323,4458 filed Sep. 18, 2001 entitled a Printer Compact Coil Winding System, Inventors Gordon B. Barrus and John Stanley Kinley.

BACKGROUND OF THE INVENTION

1. Field of the Invention

The field of this invention lies within the impact printer art. More particularly, it lies in the art of releasing a hammer with a pin to strike a ribbon for impacting a given media upon which printing is to take place. The field more specifically devolves down to the field of providing an efficient release of impact printer hammers from permanent magnetic retention and the provision of electromagnetic coils to overcome permanent magnetic retention. The invention is enhanced by a coil winding system which maximizes the efficiency of the printer and the aspects of line printing.

2. Description of the Prior Art

The prior art with respect to impact printers relies upon the impacting of a ribbon with a hammer having a tip on it. The tip specifically impacts the print ribbon and places a dot on a media to be printed upon.

The printing takes place in a manner so that a dot matrix characterization of alpha numeric, bar code and other printing can take place. This particular type of printing is effected oftentimes by high speed line printers.

Line printers generally have a hammerbank with a plurality of hammers. The hammers are lined up to print in a bank or line of dots across a specific media moving past the hammer tips. The hammers with the tips are usually retained by a permanent magnet which draws them into a secured location of magnetic retention. The magnetic retention is overcome by electromagnetic coils. These electromagnetic coils are generally wrapped around a pole piece which couples the permanent magnetism.

It has been found that the greater number of windings on a pole piece for permanent magnetic release effects greater efficiency. This is due to the fact that in order to minimize power, an increase of the number of turns and/or the lowering of resistance is desirable. The general formulation of current squared times resistance equals power is enhanced by the fact that the flux of the electromagnetic coils when combined with the equation of power creates a result wherein the larger number of turns results in lower power requirements. In effect, if greater turns of wire in the same space or through geometrically improved overlapped layers can be utilized by the electromagnets for overcoming the permanent magnetism on the pole pieces, the relative power is reduced. Also, when reductions in power are encountered, more facile and discrete printing can take place.

Recently, it has been common to have hammerbanks and line printers formed as dual rows, banks, or lines of hammers and tips. This is based upon an upper row or line of hammers and a lower row or line of hammers. One row or line of hammers prints one particular line while the other set prints another line. In this manner, multiple or dual line printing can take place simultaneously with the placement of the hammerbank in a specific location regarding the media to be printed upon.

When utilizing dual rows of hammers, it is preferable to reduce the gaps or spaces between the hammers if possible and/or maximize the number of coil turns to reduce power concurrent with the largest thickness of wire to lower resistance. The geometry of such winding on the pole pieces is such wherein there is a difficulty created due to their compact nature. Further to this extent, the electromagnetic coils of the pole pieces are generally magnetically in series. An upper and lower portion of the pole pieces are wound with a series winding, making the compaction problem more acute.

In order to enhance the ability to make compact coils wound around the pole pieces, the applicant's invention utilizes a winding system to maximize the placement of wire on a pole piece in one dimension while eliminating enlargement in another dimension. This diminishes the spacing between pole pieces.

The breadth of the pole piece is utilized to place the excess winding that is desired to avoid increasing the overall width of the pole piece winding. Since width relates to the placement of adjacent or side by side coils, the width dimension becomes somewhat controlling as to compaction of adjacent coils. When considering the maximum winding as to its proximity to another coil, this inventive winding effects an enhanced orientation for closer more compact coil relationships.

Previously, it was difficult to provide an odd number of layers of wire on a coil bobbin such that the leads started and finished at the same end of the coil bobbin. Instead, the winding started and finished at opposite ends of the coil bobbin. This particular limitation reduced the possible coil turns and combinations when in a confined space. If there wasn't enough room for six layers the extent of the winding would have to be limited to four layers. This invention allows a fifth layer, or other odd number of layers or coil combinations.

This invention overcomes the deficiencies of the prior art by winding layers that increase the pitch or spacing for winding another pitch or more located between the increased spacing. The greater pitch is spaced to place one third, one half or more of the number of turns between the windings. The wire is pitched back down to the starting position netting the equivalent of an additional layer or portion thereof as the case may be. The crossings increase the breadth but not the width.

A further embodiment incorporates a first winding in one direction and a longitudinal return along the coil. Another winding then overlies the longitudinal return. This increases the breadth of the coil without increasing the width in an undesirable manner. The result is to allow coils having increased winding in closer proximity.

With the foregoing systematic approach of winding coils, this invention finds great utilization in the winding of line printer coils.

SUMMARY OF THE INVENTION

In summation, this invention utilizes a compact wire winding system for adjacent coils by winding layers of wire in multiple pitches or spacing of the wire to place a lesser number of turns on a winding in one direction and then increasing the turns back to the starting point which nets the equivalent of an extra, or portion of an extra layer. The winding can also provide for a directional winding with a longitudinal return which increases a less critical dimension such as the breadth of the coil rather than the width in order to diminish spacing between the widths of coils.

More specifically, the invention utilizes a spacing of the turns in a given direction winding. The spacing relates to the pitch in even or multiple spaces or other such gaps depending upon the winding desired. This allows for the wire to be then fed into the gaps in the winding going in the other direction while providing for crossovers in the less critical dimension of the breadth.

The crossing of the windings can also be enhanced by a winding outwardly that has the turns crossed by a longitudinal return overlying the windings. The direction of the return is directionally along the axis of the pole pieces.

The crossing of the turns and wires occur at locations that are not critical dimensions occurring at the coil breadth dimensions. This is particularly important when coil width control and dimensions are required to be maintained in the most compact manner. The feed of the wire on the return can be with a crossover arrangement in multiple arrangements to be expanded on hereinafter in multiple embodiments.

The invention utilizes a wire payout needle which winds the wire around the pole pieces and bobbin frame by movement in a rotational manner or in some cases the needle itself in a rotational manner around the pole pieces and bobbin frame.

Feeding of the needle relatively inwardly and outwardly also enhances movement of the overall winding creates the spacing, pitch, or longitudinal crossing of the wire back to the beginning of the wind.

A group of jaws and holding fixtures can be utilized with a program for winding the bobbins around the pole pieces to effect a specific winding configuration that is desired. This winding configuration can be programmed for any particular type of winding that is desired in order to net the compact relationship of the invention and the system for winding.

BRIEF DESCRIPTION OF THE DRAWINGS

FIG. 8 shows a fully wound bobbin with a second bobbin being wound.

FIG. 9 shows the winding completed on four windings or even numbered windings on the second bobbin wound.

DESCRIPTION OF THE PREFERRED EMBODIMENTS

Figure 1:
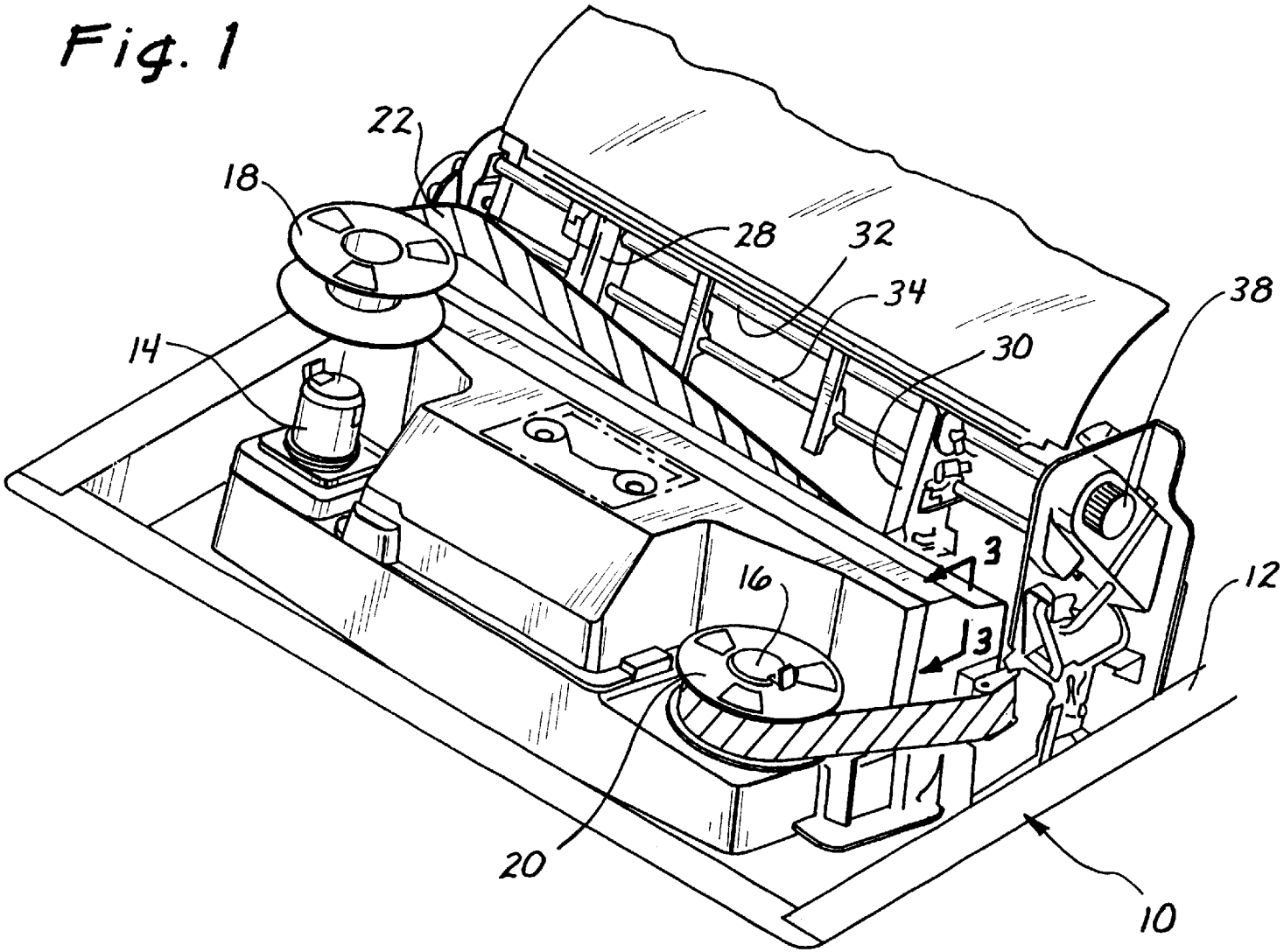
FIG. 1 shows a perspective view of a portion of a line printer utilizing this invention.

Looking at FIG. 1 it can be seen for purposes of explanation that the showing of a line printer is set forth in a perspective view. In particular, the line printer having a base 10 is shown that can be mounted on a console or a portable movable base having a frame 12 supporting the remaining portion of the line printer. In this particular case, the line printer is shown having a left hub 14, and a right hub 16, on which spools 18 and 20 are mounted. These two respective spools 18 and 20 are wound with a print ribbon 22.

The particular showing of FIG. 1 shows the spool 18 being emplaced on the hub 14 with the spool 20 already mounted on hub 16.

The print ribbon 22 moves backwardly and forwardly in a transversal across the line printer hammers. This allows the ribbon to be impacted and emplace a dot matrix configuration on the media that is being printed.

The media is paper in a fanfold configuration being driven by a tractor on either side namely tractors 28 and 30 that move the paper across the throat of the printer.

The tractor units are driven by a splined rod 32 and can be adjusted along the length of a support rod 34.

The media such as the paper can have a plurality of punched out portions driven by the tractors 28 and 20. The paper can be advanced by a knob 38 moving the splined rotating rod 32 in order to advance the media.

Figure 2:
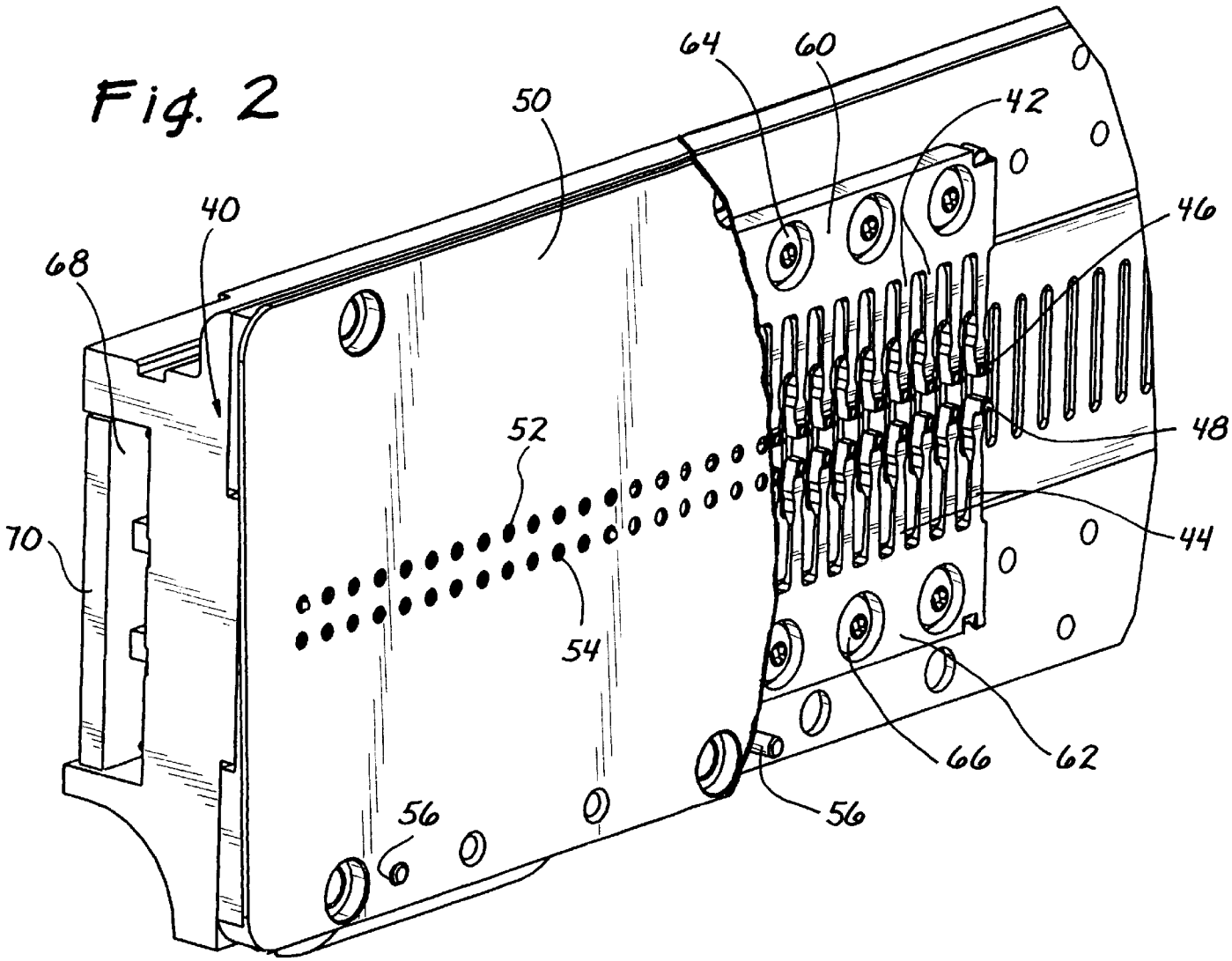
FIG. 2 shows a fragmented perspective view of a hammerbank with the cover partially broken away.

FIG. 2 shows a fragmented portion of a hammerbank 40. The hammerbank comprises a plurality of hammers 42 in an upper bank or line and hammers 44 in a lower bank or line. These respective hammers 42 and 44 have tips or pins 46 and 48 projecting therefrom in order to provide for the dot matrix printing of this invention. When the print ribbon 22 passes thereover, it is impacted by the tips 46 and 48 in order to place a dot or plurality of dots on the media.

The hammerbank has a cover 50 with a plurality of openings 52 for receipt of the upper pins or tips 46 and openings 54 for receipt of the lower pins or tips 48. The cover 50 is incorporated with a mask assembly in order to mask the ribbon from the media.

Cover alignment pins such as pin 56 is utilized for holding the cover 50 in its respective location for proper orientation of the cover on the hammerbank.

Each of the upper hammers 42 and lower hammers 44 forming a line are supported and formed on frets 60 and 62. These frets 60 and 62 can comprise a multitude of hammers. Such frets 60 and 62 are generally machined or cut by electro-discharge milling from a single piece of metal so as to provide the hammers in the particular format as shown. The tips 46 and 48 are then formed or welded, braised or connected in any suitable manner to the hammers 42 and 44.

The frets 60 and 62 are secured to the hammerbank by means of securements 64 and 66 which can be threaded attachments such as screws, nuts or bolts, etc.

The hammerbank 40 is formed as a machined element from a casting in any suitable manner to provide a slot 68. The slot 68 receives a circuit board 70 which can have the logic, power, and drive for the hammers. The circuit board 70 can be connected to the controller or another portion of the printer by means of a flex cable or other suitable means.

Looking more specifically at FIG. 3 which has been sectioned along lines 3—3 of FIG. 1 it can be seen that the hammerbank 40 is shown in greater detail with the coils and pole pieces as detailed hereinafter. In particular, the hammerbank 40 is shown with the frets 60 and 62 and their respective hammers 42 and 44. Also, the tips 46 and 48 of the hammers are shown for striking the ribbon 22 which passes thereover. The cover 50 is also shown mounted thereon.

The hammerbank 40 has electrical components on the circuit board 70 with connectors 80 and 82 for the upper hammerbank portion and connectors 84 and 86 for the lower hammerbank portion.

A bobbin and frame configuration or assembly 88 for the upper assembly of hammers is shown. A like bobbin and frame configuration or assembly 90 is also shown. These frame or bobbin configurations are split along their axial portion and receive pole pieces 92 and 94 for the upper set of hammers and 96 and 98 for the lower set of hammers.

These respective pole pieces are made of magnetically conductive metal and receive permanent magnets 100 and 102 respectively in the upper and lower pole pieces. The pole pieces can be laminated as shown to reduce eddy currents they can also be solid pole pieces. The ability to use solid pole pieces is enhanced by this invention because although the eddy currents might increase, the power saved diminishes the effect due to eddy current losses. These respective magnets 100 and 102 magnetically retain the hammers 40 and 42 against the pole pieces 92, 94, 96, and 98 until released by electromagnetic power overcoming the permanent magnets 100 and 102.

The electromagnetic force in order to overcome the retentive magnetism of the magnets 100 is provided through an upper distal coil 110 and an upper proximal coil 112. In like manner a lower distal coil 114 and a lower proximal coil 116 are utilized to overcome the magnetism of the respective magnet 102.

One of the main reasons for this invention is to allow for compact winding of the coils 110 through 116 with respect to their width and breadth. The breadth being shown as the dimension seen in FIG. 3 and the width being orthogonal thereto. These dimensional relationships will be defined more fully in FIG. 4.

With increased windings, less power is utilized with respect to given wire diameter. The power is decreased or minimized by increasing the number of turns or lowering resistance. In effect, when increasing the number of turns or lowering the resistance, less power is required for the electromagnetic magnetism to reverse the permanent magnetism of the magnets 100 and 102. In this manner less power is lost to heating. Thus, one of the major reasons for this invention is the ability to apply extra turns to bobbins and frame members 88 and 90 in close proximity to each other as to their width and the respective proximal and distal coil spacings.

Figure 4:
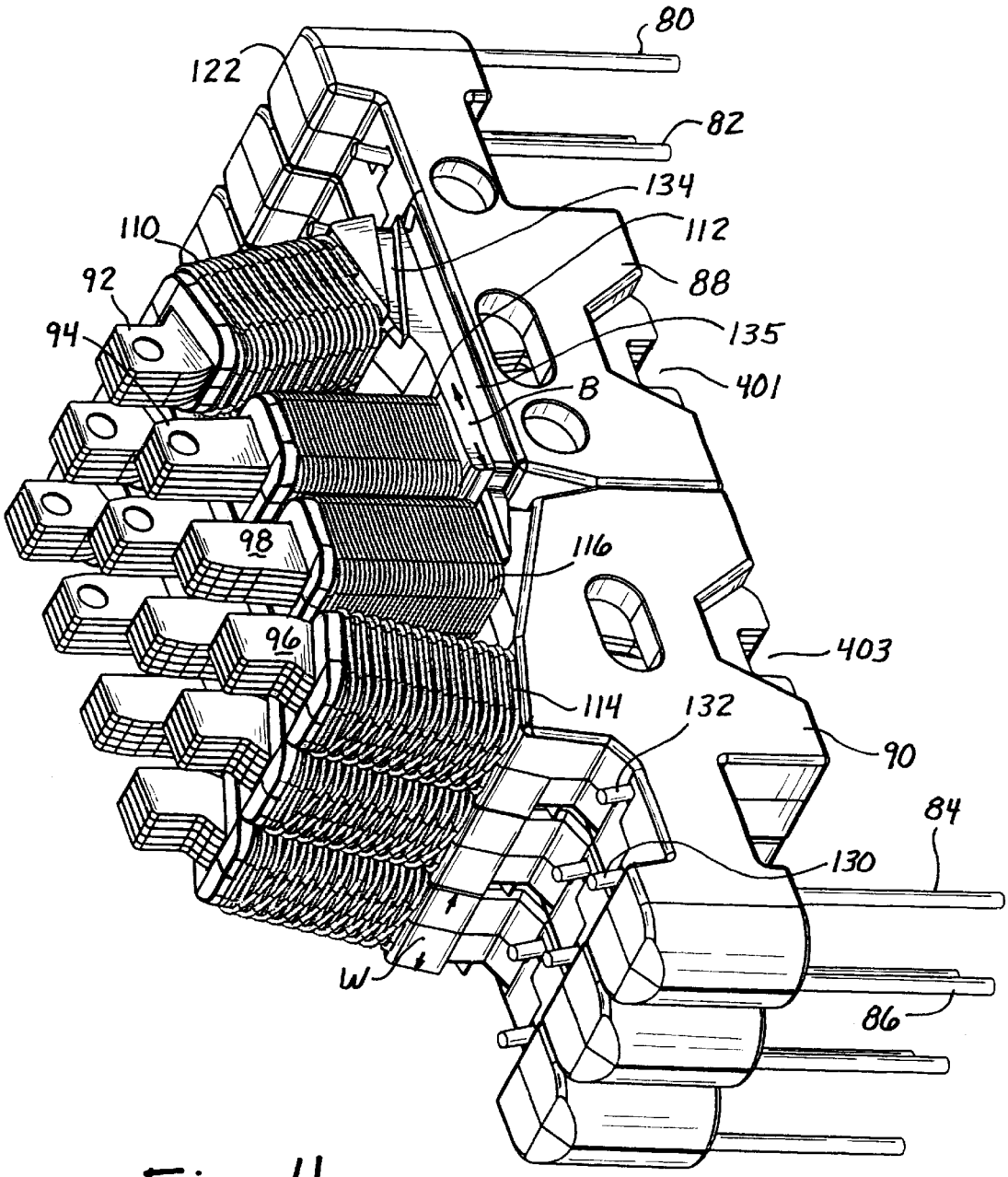
FIG. 4 shows a detailed perspective view of the windings as shown in FIG. 3.

Looking more particularly at FIG. 4, the details of the coils 110 through 116 and the bobbin and frames members 88 and 90 can be seen. FIG. 4 shows the bobbins and frame members 88 and 90 with the respective coils 110 through 116. These respective coils 110 through 116 have been wound on the frames and bobbins 88 and 90. Although showing laminated pole pieces in FIG. 4, it should be understood that this invention enhances the ability to use solid or non-laminated pole pieces as well.

The frames and bobbins 88 and 90 are formed in a bifurcated manner in a split along line 122. These splits or parting lines 122 allow the frame and bobbin members 88 and 90 to be joined together and hold the respective pole pieces shown as pole pieces formed of laminated metal members. The pole piece eddy currents are reduced by the lamination of pole pieces 92, 94, 96, and 98. Nevertheless the reduction in power due to this invention allows the use of solid or non-laminated pole pieces even though a certain amount of power might be lost through eddy currents.

The pole pieces 92, 94, 96, and 98 can be stamped or milled terminating in the ends of the pole pieces adjacent the hammers 40 and 42, shown as extensions of the pole pieces 92, 94, 96, and 98. When formed this way, a slot 401 and 403 is provided that receive the magnets 100 and 102 respectively. Also, as can be seen connectors 80, 82, 84, and 86 are shown having extensions passing therefrom which provide for the connection of the circuit board 70 and its drivers to the coils 110 through 116.

Each set of coils 110 and 112, and set 114 and 116 are wound on a bobbin or frame such as frame 88 or 90. The distal coils and the proximal coils are wound in series. This can be seen as the series winding starting at the wire connection or terminal 130 and terminating in the wire terminal connection 132. However, the windings could also be in parallel rather than in series.

The wire wound around the respective distal and proximal coils 110 and 112 is in series starting at wire connection or terminal 130 and terminating at wire or terminal connection 132. The windings in some cases, as previously stated, can also be such where they are electrically in parallel.

The initial wire connection starting at the connecting point 130 traverses a slot 134 on the bobbin or frame 88. The slot 134 allows the wire to be wound around the bobbin in the manner to be described. Thereafter, the wire returns to the connection point 132 in the return slot 135. This is also true of the distal and proximal coils 114 and 116 except in a reverse manner.

The width (W) and the breadth (B) respectively of the coils when spoken herein refers to the following. The width (W) of the coil is measured across the distance shown as width W of FIG. 4. The breadth (B) of the coil is shown as the breadth B in FIG. 4. The breadth and the width of the coils are orthogonal to each other.

As can be seen from FIG. 4, the width W of the coils when packed together in their multi-coil function provides for a very tight and compact relationship. Also, the proximal and distal coil combination must be accounted for with regard to the breadth B of the coil due to the number of windings. This invention enhances the ability to increase greater breadth B of the coils such as the distal coils 110 and 114 due to the winding thereof while at the same time enhancing the narrowness of the width W.

A first description of the invention in FIGS. 1 through 15 is directed toward the crossover, skipped pitch concept. The one hereinafter is directed to a single wire return after each winding in FIGS. 16 through 22 so as to place the return on the outer portion of the coil. This limits the width while increasing the breadth in a non-critical location by one wire upon each return.

Figure 3:
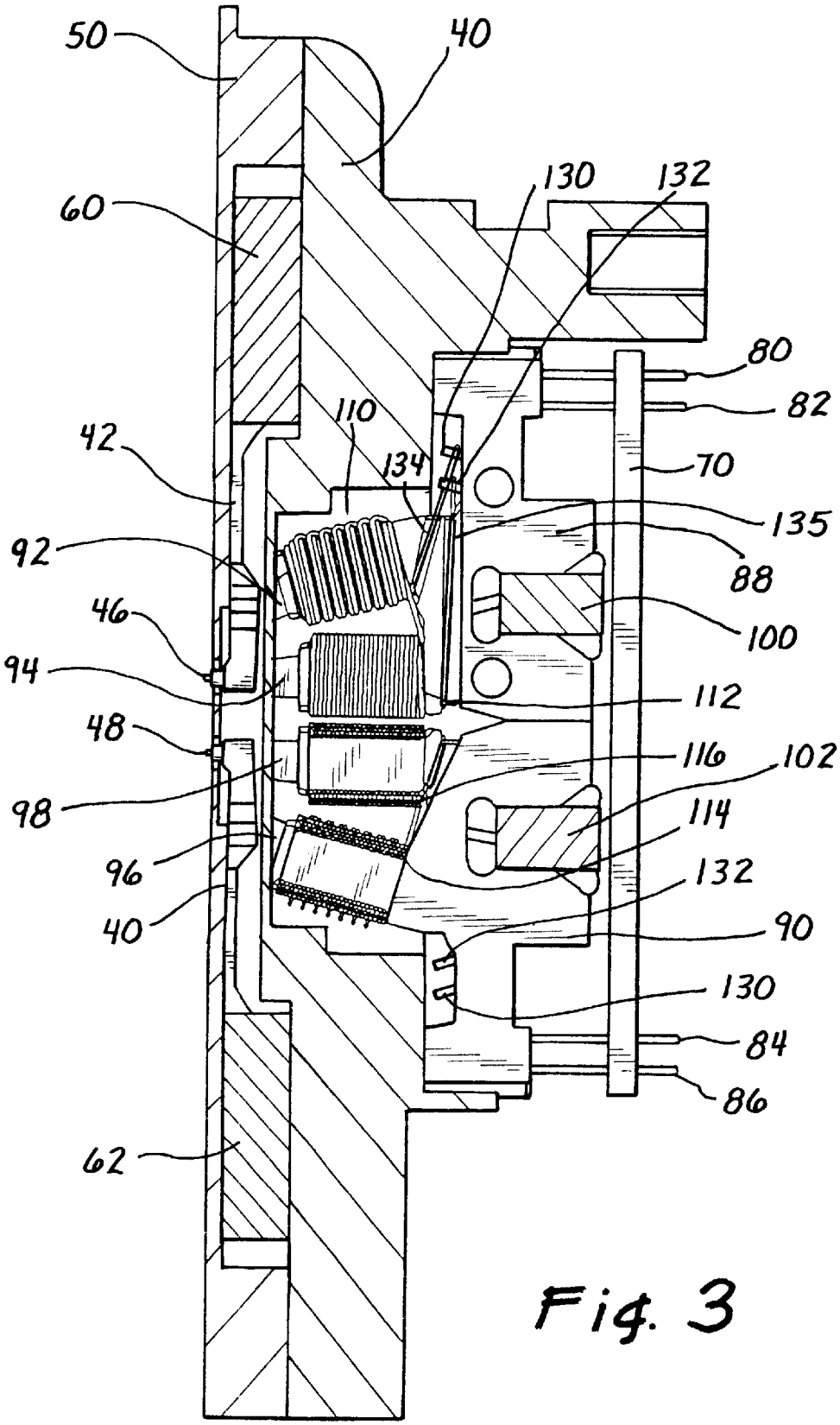
FIG. 3 shows a sectional view of a three pitch winding scheme for the bobbins and coils of this invention as sectioned along lines 3—3 of FIG. 1.

In reference to FIGS. 3 and 4, the windings of the coils are shown as four windings on the proximal coils 112 and 116 and five windings on the distal coils 110 and 114. These respective windings are such wherein the windings on the proximal coils 112 and 116 are tightly wound onto each other without any spacing, and in a single pitch orientation. In effect they are wound with a single pitch without any gaps as the windings are laid down. The distal coils 110 and 114 are wound so as to provide for four windings initially with a fifth winding incorporating a staggering, spacing, or pitch of three wires which are filled in with a reverse traversing of the bobbin.

The last winding starts out on the distal coils 110 and 114 by skipping a second and third pitch in each case and filling in with one or more wire windings thereafter. Thus, winding orientation or pitch, depending upon the number of windings skipped in the next to last windings can effectively provide for variable dimensions as to width W and breadth B of the coils for enhanced packing of the coils in a tightened configuration as seen in FIG. 4.

Another consideration is that the terminal points of the windings should terminate towards the rear of the coils or proximate the wire connections 130 and 132. For a winding to be effective it should not terminate at the forward end or closest to the ends of the pole pieces proximate the hammers 40 and 42. If so, the wire must be run backwardly in another path to its respective wire connection 132 or a like connection.

Figure 5:
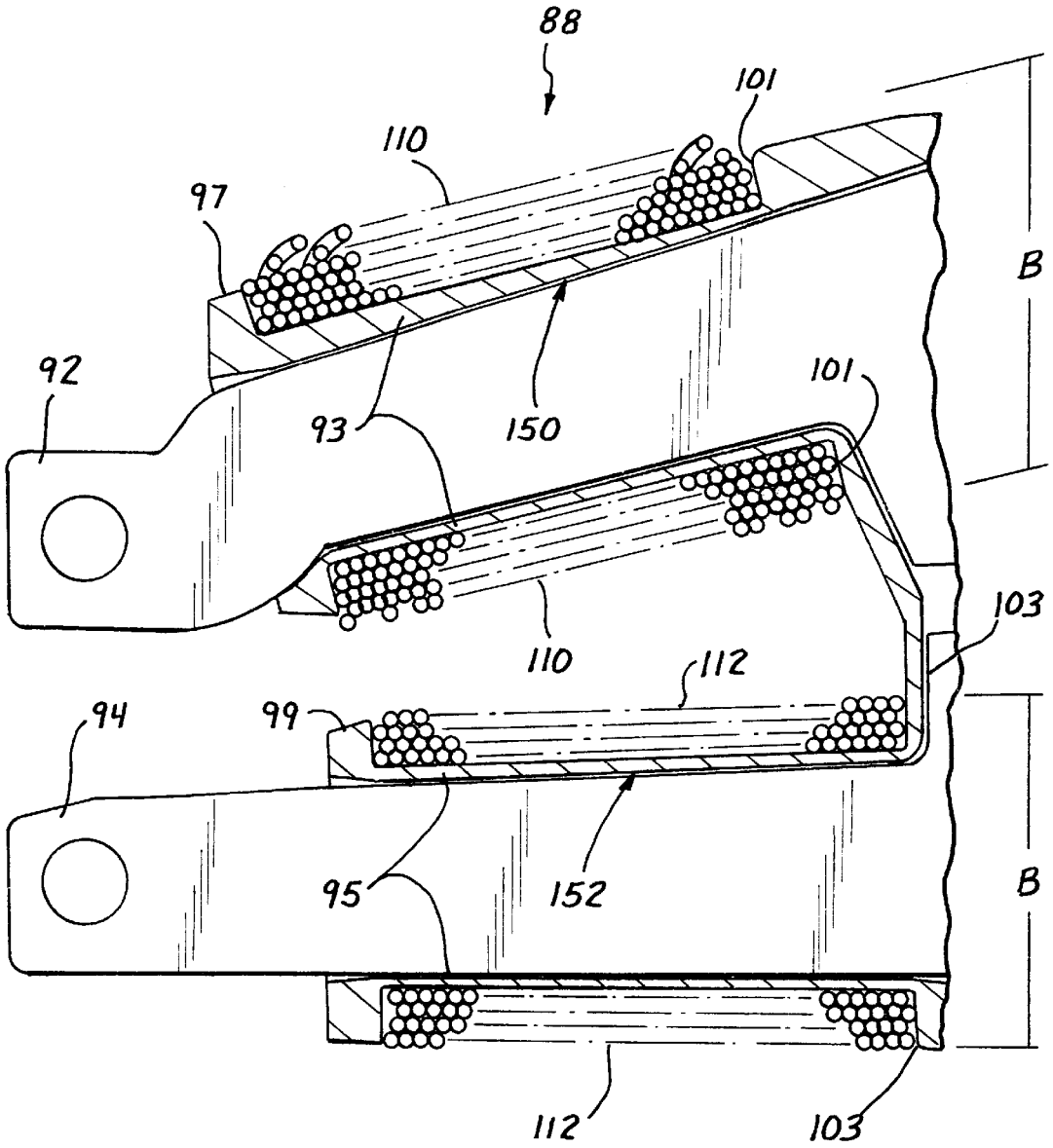
FIG. 5 shows a sectional view of the windings on a frame with two bobbins showing a three pitch orientation with the ability to fill in between the wires with two extra wires for enhanced winding compaction.

Looking more particularly at FIG. 5 which shows the bobbin and frame 88, it can be seen that the pole pieces extend outwardly. The upper pole piece 92 magnetically returns through the lower pole piece 94. This is true as to the permanent magnetism with the hammer 42 serving as the magnetic bridge. The bobbin itself formed on the frame and bobbin member 88 is shown as a plastic bobbin member 150 on the upper portion and 152 on the lower portion which wrap around the magnetically conductive pole pieces 92 and 94.

The lower pole piece 94, proximal coil 112 has a total of four windings in the form of wire that has been wrapped around the bobbin 152 in directly overlapping non-staggered single pitched relationship.

When looking at the upper bobbin portion 150 surrounding the pole piece 92 it can be seen that the wire of the distal coil 110 has been wrapped with a total of five windings. The first four are even and one pitch wrapped on each other. The last winding comprises a winding in one direction that is spaced, and a return in the other direction as a filling winding. The final windings are staggered so that there is a three pitch, or skip of windings which are then filled in between with one winding in the spaces which could also be two windings. The breadth as taken in the dimension of B shown in FIG. 5 and in the other figures can be increased for purposes of greater numbers of windings while at the same time allowing a termination toward the rear of the pole pieces. Also, coils 110 and 112 could have staggered windings for both sets of coils to decrease relative width while taking advantage through increasing the breadth of each coil.

The totality of windings is such where there are four on the proximal coils 112 and 116 and five on the distal coils 110 and 114 unless all are staggered. This is true even though the distal coils 110 and 114 have been wound in each longitudinal direction after the first four windings. In the three pitch configuration only every third winding of the fifth winding is wound with a gap of two spaces therebetween. The breadth B of the proximal windings 112 and 116 is only four exact windings while the distal windings 110 and 114 comprise a total of five windings.

Figure 5A:
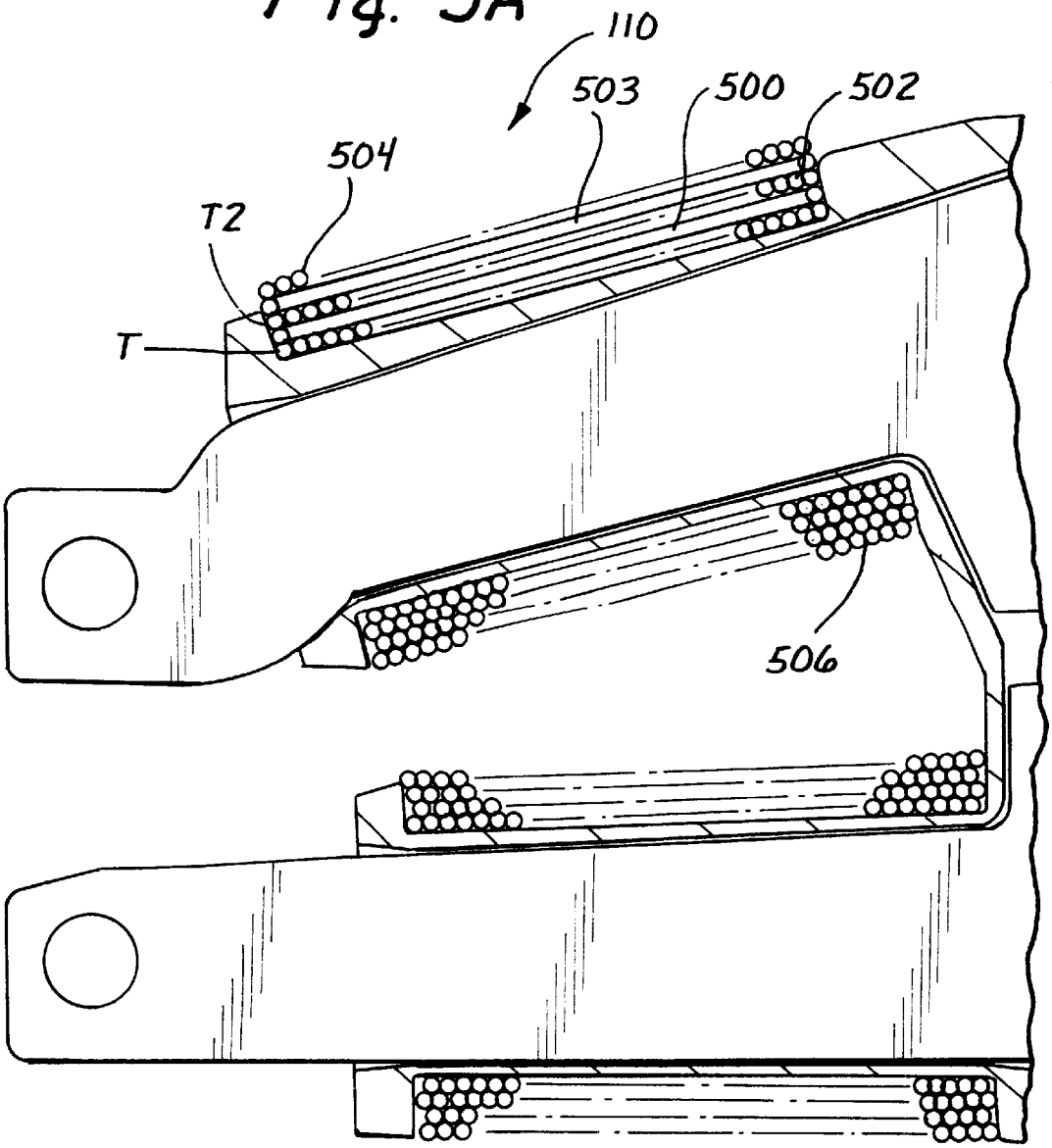
FIG. 5A shows a similar view to FIG. 5 with an alternative embodiment.
Figure 6:
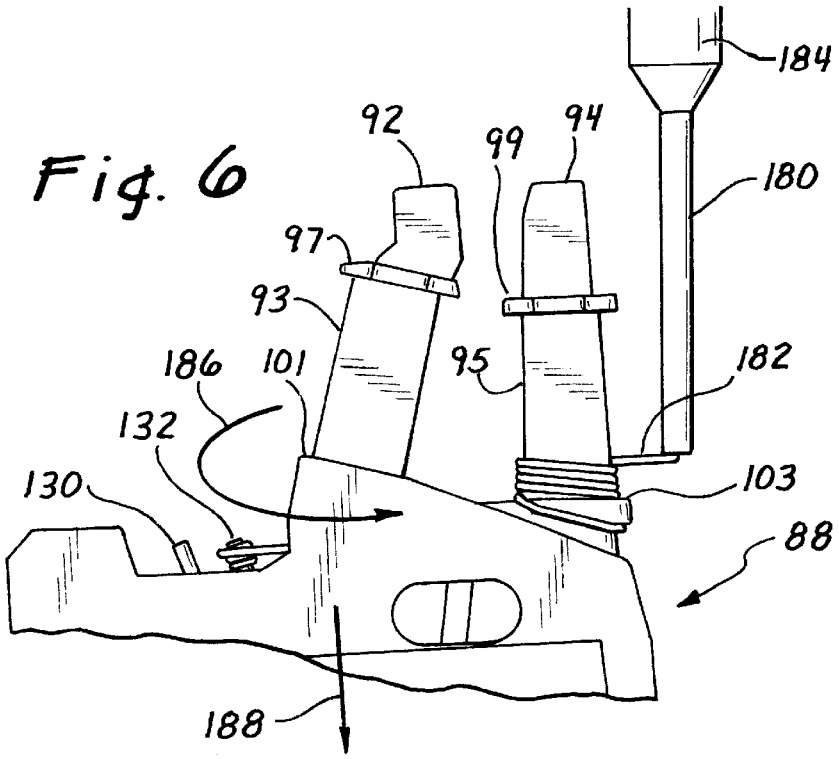
FIG. 6 shows a side elevation view of the bobbin on the pole piece being wound.

Looking more specifically at FIG. 5A, it can be seen that an alternative winding configuration is shown. In this particular instance, the winding configuration shows the fact that windings have been wound into a helix in the distal coil 110C. Coil 110C has been wound so that at the termination of each winding such as at point T, the wire returns by way of a wire return running along the upper portion of the width in the form of wire running along the width of the outer breadth portion.

The return wire is shown as wire 500. The wire is returned and the second winding takes place along the width of the outer breadth as winding 502. Winding 502 then terminates at T2 and returns in the form of wire 503. The next windings on top of wire 503 are generally shown as windings 504. This process continues depending upon the number of helixes to be wound.

In this manner, the breadth can be increased with return of the wires 500 and 503. Here again, on the bottom portion, the windings are formed in relative tangential arcuate contact with the respective winding along the width so that a compactness of windings 506 takes place providing for multiple windings in a compact helical relationship. As a consequence, the return wires 500 and 503 can be returned in any particular manner along the outer breadth of coil 110C and across the width thereby building up the outer portion but not the inner portion between the respective coils.

Looking more specifically at FIGS. 6 through 14, it can be seen how the winding process takes place. The winding process has been shown with relative movement of the bobbins and frame assembly 88 or 90. For purposes of convention, the bobbin and frame assembly 88 will be described in the winding process.

The ends of the pole pieces 92 and 94 are shown extending through the plastic bobbin portion that is split and in part covers the metal pole pieces.

The winding takes place on the bobbin members 150 and 152 of the frame and bobbin 88 which will be described specifically as the bobbins 93 and 95 respectively with regard to the pole pieces 92 and 94.

Each bobbin respectively 93 and 95 has a flange, disk, or terminal wall that surrounds it toward the end proximate the extension of the pole pieces 92 and 94. These are seen in the form of the end flanges 97 and 99 as they pertain to the respective bobbins 93 and 95.

At the other end of the bobbins 93 and 95 are stop positions created by the frame and bobbin 88 terminating at flanges or ledges. These are seen as terminal points, flanges, ledges, or stop points respectively 101 for bobbin 93 and 103 for bobbin 95.

In order to wind the wire on the respective bobbins 93 and 95, relative motion is imparted to the frame and bobbin member 88 as it rotates around a needle 180. Needle 180 receives a supply of wire 182 at its end 184. The wire supply from its end 184 can come from any source. The rotational movement of the bobbin and frame member 88 is in the direction of arrow 186. In order to feed the wire 182 onto the bobbins 93 and 95 during winding, the bobbin and frame member 88 moves in the direction of arrow 188.

The foregoing causes the winding of the wire 182 through the relative motion in the direction of arrows 186 and 188 to extend between the flange or step 103 and the bobbin flange 99. The winding of wire 182 extends to its initial winding portion from the terminal connector 132 and is wrapped initially from the flange extension or ledge 103. The winding is formed with four successive layers. The successive layers can be of any other number so long as the relative degree of compaction is maintained as to the width W and breadth B. Also, the last winding should terminate toward the rear of the bobbins at stop points or ledges 101 and 103.

Figure 7:
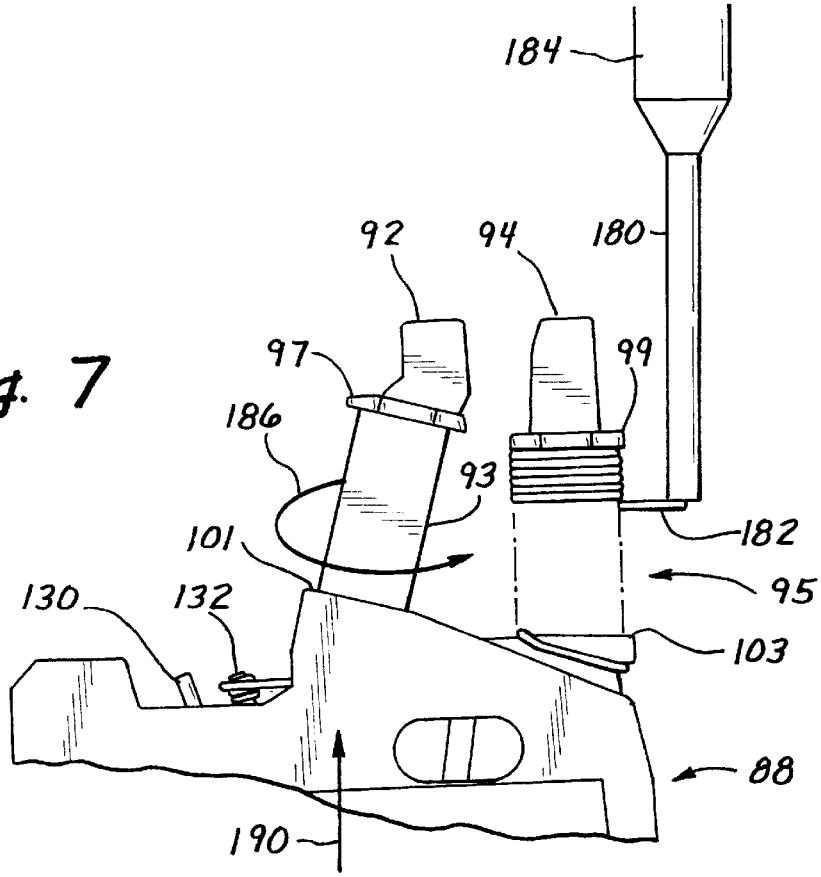
FIG. 7 shows a last winding being effected on the pole piece after the fourth or even layer thereof.

As seen in FIG. 7, the wire 182 has extended out to the fourth or final winding that has been built up as shown by the dotted lines on the bobbin portion 95. Here again, it can be seen that the rotational movement is in the direction of arrow 186. However, the in and out movement is shown as a relative movement in the direction of arrow 190. This causes the movement of the frame member or bobbin 88 to move in the reverse direction of arrow 188 so that the winding is paid up finally against the ledge 103. In effect, the in and out relative movement in the direction of arrows 188 and 190 causes the feed to traverse the bobbins 93 and 95 as rotation takes place.

In this particular case, the winding has included four wraps with no spacing between them, in single pitch orientation. The overlay of the wraps of the wire 182 are such that they make a continuous wrap in a smooth and consistent manner for flush relationship generally within the bounds of the ledge 103 and terminal flange, disc or stop 99.

Here again, it should be understood that relative rotational movement of the needle 180 can take place around the bobbin 95 or as in this case the bobbin moved in the direction of arrow 186 for wrapping purposes. It has been found preferable as to the feed of the wire, to avoid less twist, that the bobbins 93 and 95 should be rotated around the needle 180.

Looking more particularly at FIG. 8 after the bobbin 93 has been wound, it can be seen that the needle 180 has moved to within the space between the bobbins 93 and 95. At this point, the bobbin 95 around the pole piece 94 is then rotated in the direction of arrow 202 in order to wrap the wire 182 being paid out from the needle 180. As it wraps around the bobbin 95, it traverses a totality of four wraps as shown in FIG. 8 in the direction of arrow 202.

In the particular showing of FIG. 8, arrow 204 indicates movement or transversal of the frame and bobbin member 88 in order to wrap the wire 182 on the winding course after it has been conveyed from the end of bobbin 93. It should be borne in mind that the wire 182 should be continuous between the respective connections 130 and 132. It should also be noted that the wire 182 when extending from the bobbin 93 as coil 112 extends from the last of the winding on bobbin 93. This extension can be seen as extension 212 of the wire extending from the end of the winding on bobbin 93.

Figure 10:
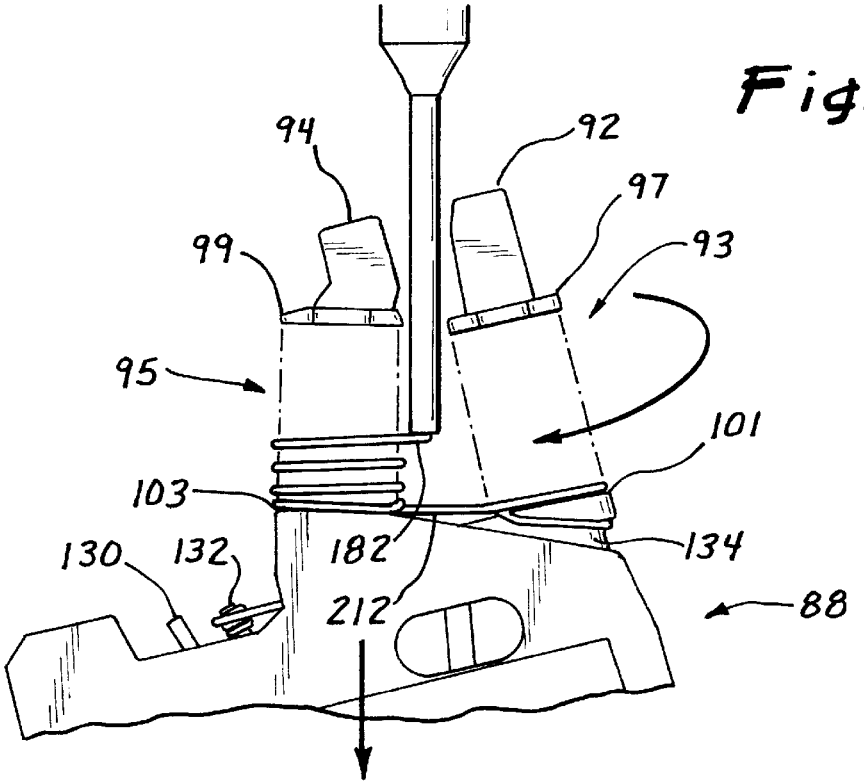
FIG. 10 shows the needle winding a three pitch winding wherein the winding is skipping to allow insertion of up to two wires between the winding.

As the frame and bobbin 88 rotationally turn around in the direction of arrow 202, the movement of the bobbin 95 inwardly and outwardly can be seen in the reciprocal manner as the frame and bobbin member 88 moves in the direction of arrow 216. This movement in the direction of arrow 216 provides for the final continuous four layer wrap of single pitched wrap without any gaps or spaces. After the wire 82 has been wrapped down to the base or terminal ledge 103, it is then wrapped with a fifth wrap as seen in FIG. 10 with a three pitch configuration having a gap of two wire spaces between the wrapped wire 182. This particular winding shown in FIG. 10 is the next to last winding or wrap of the fifth complete winding and proceeds as shown in FIG. 11 to the end of the bobbin 95 at the flange, disc, or ledge 99.

Figure 11:
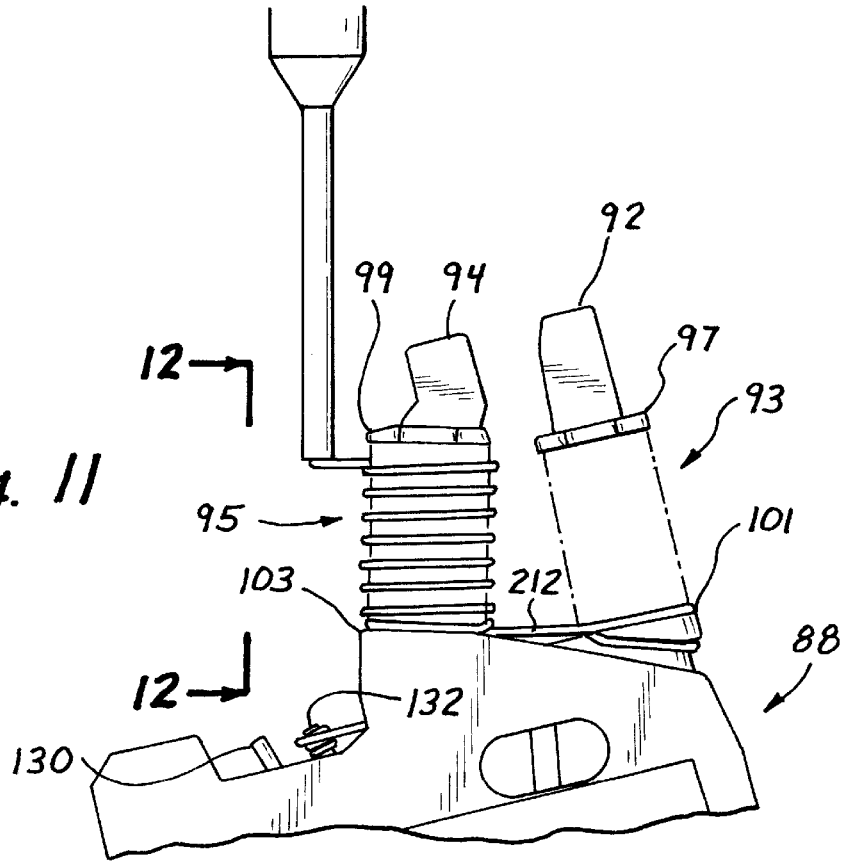
FIG. 11 shows the completion of the winding with the needle prepared to initiate winding and filling of the spaces between the three pitch winding.
Figures 12, 13, 14:
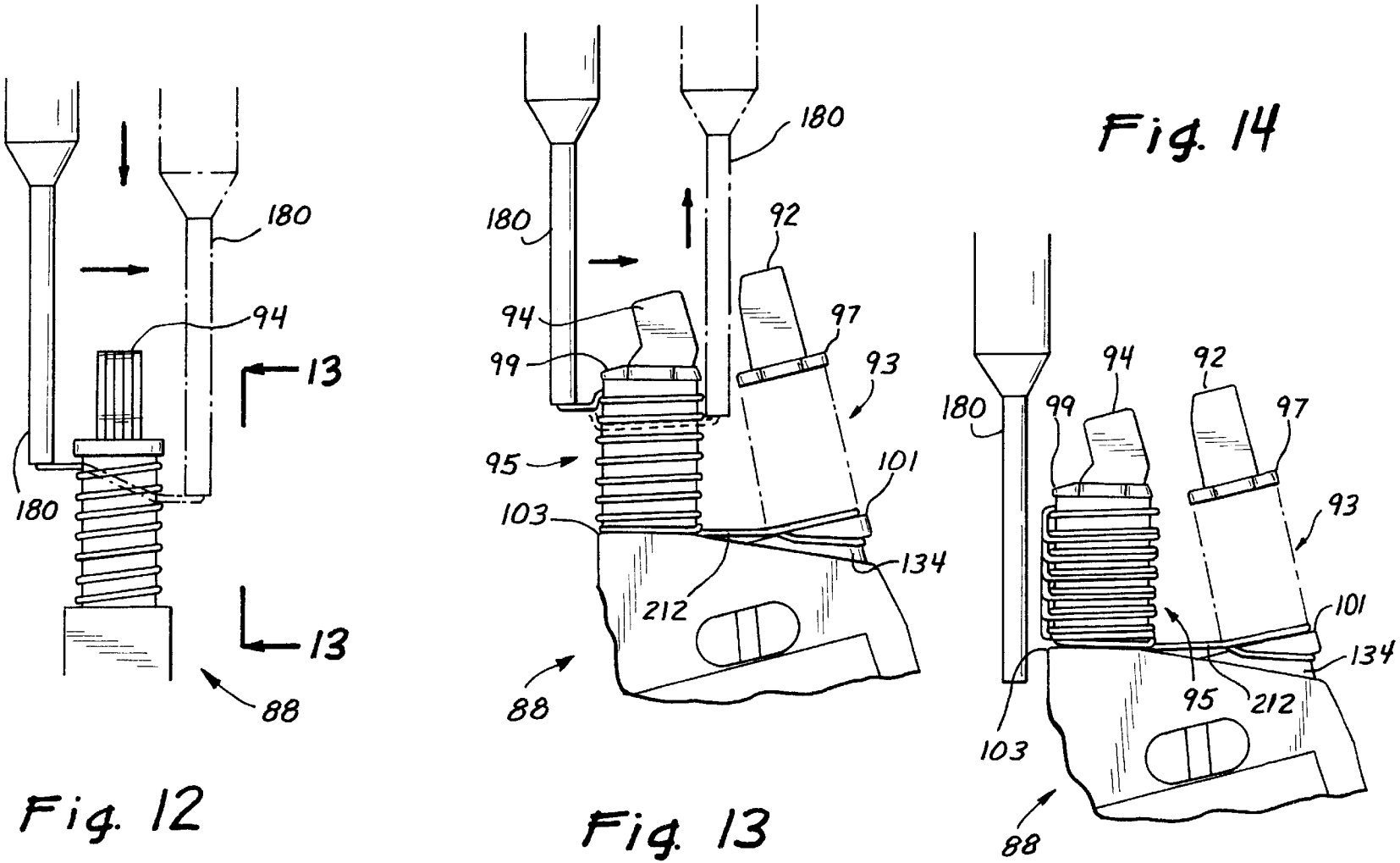
FIG. 12 shows the needle moving in proximate relationship across the wound winding to effect the windings into the spaces therebetween.
FIG. 13 shows a view in the direction of lines 13—13 of FIG. 12 with the needle moving and describing the winding of the coils and the extra layers between the gaps of the three pitch windings.
FIG. 14 shows the last of the coil being wound with the spaces being filled.

At this point, as seen in FIG. 12, the final portion of the fifth winding takes place by filling the respective gaps or spaces created by the three pitch initial winding of FIG. 11. These double gaps or spaces of the three pitch initial winding are filled. At the side across the width W removed or remote from the proximal coil 112 of the winding 110, there is a crossover. This crossover is implemented across the removed width portion by relative longitudinal movement.

As shown in FIG. 12 the needle 180 in relationship to the bobbin and frame member 88 translates or crosses over a particular initial winding at the width of the coil. This extension is across the width of the coil as seen in FIG. 13. The winding of the wire 182 is thereafter laid down in the respective double wire gaps between the three pitched wire as wound in FIG. 11.

As seen in FIG. 13, which shows the breadth B dimension of the distal coil 110, the crossover takes place at the removed or most distal width so as to not interfere within the interfacing gap between the respective coils 110 and 112. This allows for the needle 180 to pass therebetween freely and provide for the relative translation as seen in the direction of the arrows of FIG. 13.

Thus, the crossover windings as seen in FIGS. 13 and 14 have been laid at an advantageous area to not interfere within the interfacing gap between the coils 110 and 112. Bobbins 93 and 95 have a wrap of wire 182 around them forming coils 110 and 112. Bobbin 93 has four wraps while bobbin 95 has the equivalent of a total of five single pitched wraps by the final reverse wrap filling in the three pitched wrap. In summation, the last wrap of the distal coil is formed by a three pitched or spaced wrap traversing in one direction, and a wire filling wrap traversing in the other direction. The majority is filled, but not one hundred percent (100%) i.e. $4+\frac{1}{3}+\frac{1}{3}$ equals $4\frac{2}{3}$. If a double or two pitch wrap is used with a single space between each wrap before filling, the final filling can be a single wire between the two pitches completely filling the single space with a final wrap. Thus, the one hundred percent (100%) double pitch provides $4+\frac{1}{2}+\frac{1}{2}$ windings making a total of five (5). This is shown in FIG. 15.

The winding as shown in FIG. 11 that initiates in FIG. 10 allows for the wire to terminate at the end of the bobbin 95 so that it can then be wrapped around terminal 130. Terminal 130 receives the terminal end of the winding and allows it to be secured thereon after the last winding or filling of the pitched wrap of the coil 110 has taken place. This final winding is fed down to the terminal 130 through a groove 135 that is on the same side as groove 134. This can be seen in FIG. 4 where the groove extends along the base of the frame and bobbin member 88.

As shown in the Figures, it can be seen that in the Figure descriptions 1 through 14, a next to last three pitch traversal or three wire winding has been undertaken for the distal coils 110 and 114 in order to provide for the double gaps or spaces in between.

Figure 15:
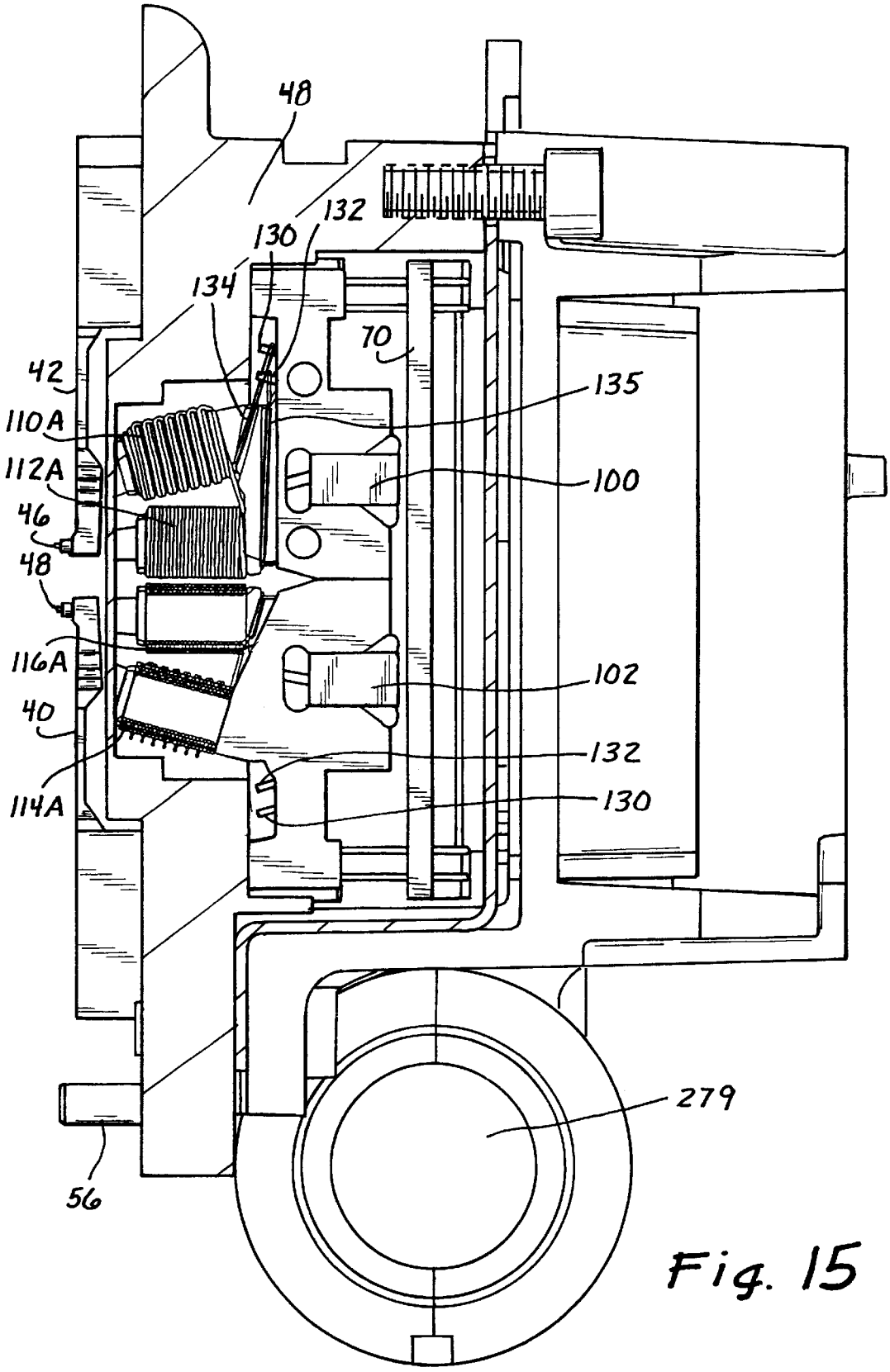
FIG. 15 shows a two pitch winding orientation with a detail of the hammerbank as sectioned through the hammerbank.

FIG. 15 shows a differently pitched orientation. As can be seen in greater detail the respective coils analogous to coils 110 and 114 have been wound with a double pitch rather than a three pitch next to last winding. The double pitch is such where a gap of one wire is between each respective doubled pitched wire. In all other respects, the configuration is the same.

Thus, as can be appreciated other multi-pitched configurations can be oriented such as two and four pitched coils as deemed by the total number of turns required and the manufacturability. For purposes of explanation, the alternative embodiment of the coils 110A through 116A are analogous to coils 110 through 116 as shown.

In addition to the showing of the hammerbank analogous to that showing of FIG. 3, a lug 279 has been shown supporting the hammerbank which serves to oscillate and drive the hammerbank in a reciprocating manner. Thus, the only difference in the respective showings of the double tiered or double line of hammers using coils 110A through 116A is the fact that the coils have been wound insofar as the distal coils 110A and 114A are concerned with a double pitch rather than a three pitch winding for the next to last traversal prior to filling. The double pitch has then been filled in with respect to an additional wire filled in with the appropriate crossovers for the windings skipping only two wires instead of three wires.

Other winding configurations can be utilized such that other multiple pitches can be wound. In doing so, the wire 182 should always return as to the last winding at the terminal point or the ledge 101 so that the wire can then be terminated back to the connection 132.

The three pitch winding can be seen graphically in FIG. 4 wherein the crossovers are shown on the distal coils 110 and 114. The double windings are seated between the three pitched single windings. The totality makes up the fifth complete winding. Other winding relationships can be used with odd windings formed as the third, seventh, ninth, eleventh, etc. complete winding wound on second, sixth, eighth, and tenth windings. The principal is to have the last winding for compaction purposes formed of two traversals, one having spaced pitches, and the other filling in the spaces.

Figure 16:
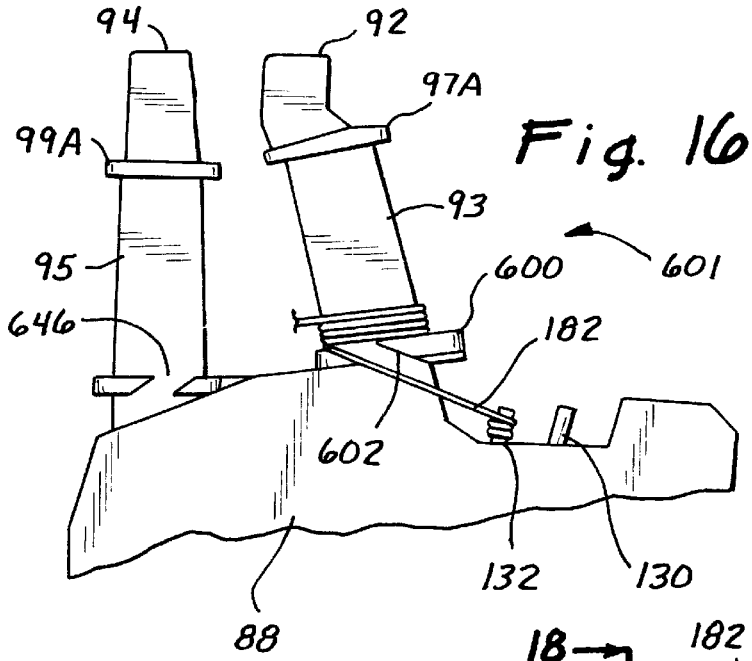
FIG. 16 shows an alternative embodiment of this invention with a fragmented side elevation of the bobbin being wound.

FIG. 16 shows the start of an alternative wrapping system for the wire 182. In particular, the bobbin and frame assembly 88 has the terminals 130 and 132 as previously described. However, in order to accommodate a different wrapping scheme to provide for appropriate space between the proximal and distal coils, the wrapping procedure of FIGS. 16 through 22 is utilized. The fundamental concept in these figures is that a winding of the distal coils which can also be applicable to the proximal coils takes place by a first winding extending outwardly toward the terminal points of the pole pieces 92 and 94 and then returns on a longitudinal return LR.

The winding is effected by turning the frame and bobbin 88 around a needle 180 having the wire 182 extending therefrom. However, the reverse and relative motion in the other direction can also take place.

In FIG. 16 it is shown that the distal bobbin 93 for the coil has a base flange portion 600. The base flange portion 600 has an angular slot 602. The angular slot 602 can be in any particular configuration so long as it allows access of the wire 182 from the terminal 132 to be wrapped around the bobbin 93 forming the base upon which the distal coil is wound. In this particular case, the coil is wrapped in a clockwise direction around the bobbin 93 extending toward the end flange or stop 97A. 97A is analogous to the flange or stop 97 in the previous embodiment. In like manner, flange 99A is analogous to the flange or stop 99 in the previous embodiment.

Figure 17:
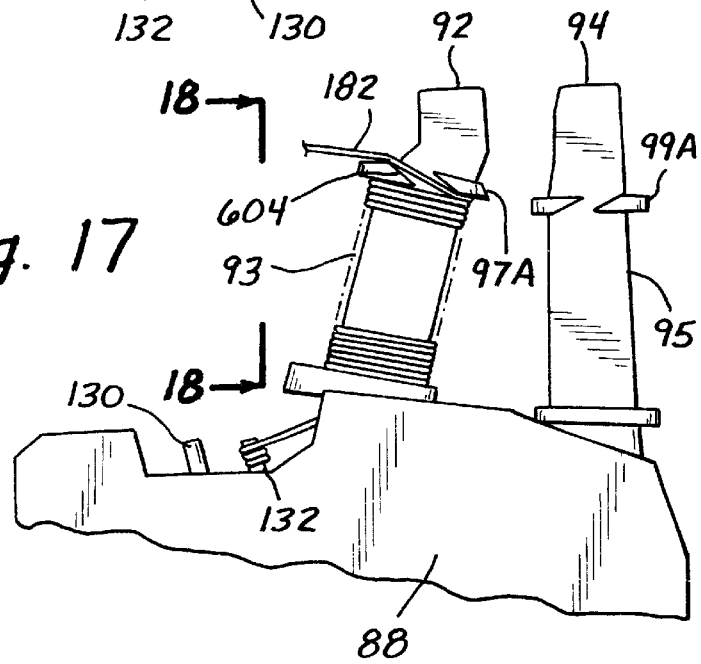
FIG. 17 shows the opposite side of that shown in FIG. 16.

As the relative movement of the bobbin 93 turns, it wraps the wire 182 around the bobbin in a clockwise wind until it terminates at the end flange or stop 97A. The end flange or stop 97A has a slot 604 therein. The slot 604 is at an angle and allows for the wire 182 to extend outwardly as shown in FIG. 17 in the direction of the pole piece end 92.

Figure 18:
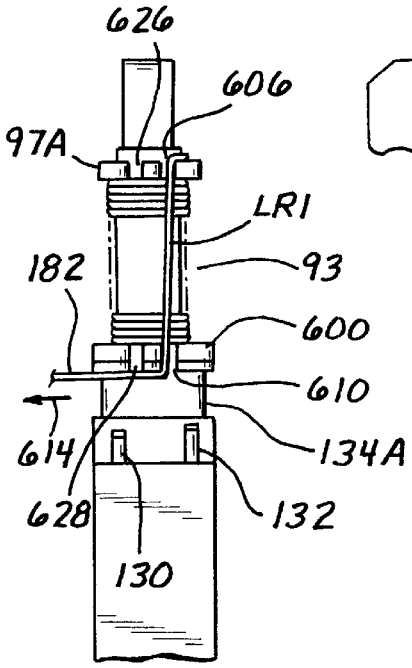
FIG. 18 shows the winding being made with the longitudinal relationship of the return wire from an end view of that shown in FIG. 17 along lines 17—17.
Figure 22:
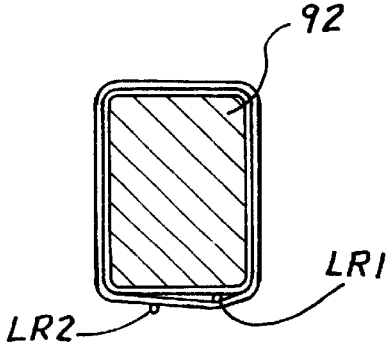
FIG. 22 is a sectional view of the winding of the wire in the direction of lines 22—22 of FIG. 20.

The wire 182 as seen in FIG. 18 then passes through a slot 606 of the end flange 97A and traverses backwardly in the direction of longitudinal return LR 1. When returning in the longitudinal direction as longitudinal return LR 1, it travels along the outside periphery of the winding shown in FIG. 17 on the removed portion of the distal coil away from the space between the two respective bobbin portions 93 and 95. In this way, the dimension on the outside of the distal coil is extended without packing wire internally into the space between the respective bobbins with their windings 93 and 95.

When the longitudinal return LR 1 passes backwardly to the flange or base 600, it then passes through a space 610 which allows it to then traverse behind the flange in the direction of arrow 614 and then through the slot 602 to be a second winding. This second winding continues in the same manner as the first winding moving outwardly toward the flange or stop 97A. This can be seen as the second winding of FIG. 19 which is being wound in the clockwise direction of arrow 616.

Figure 19:
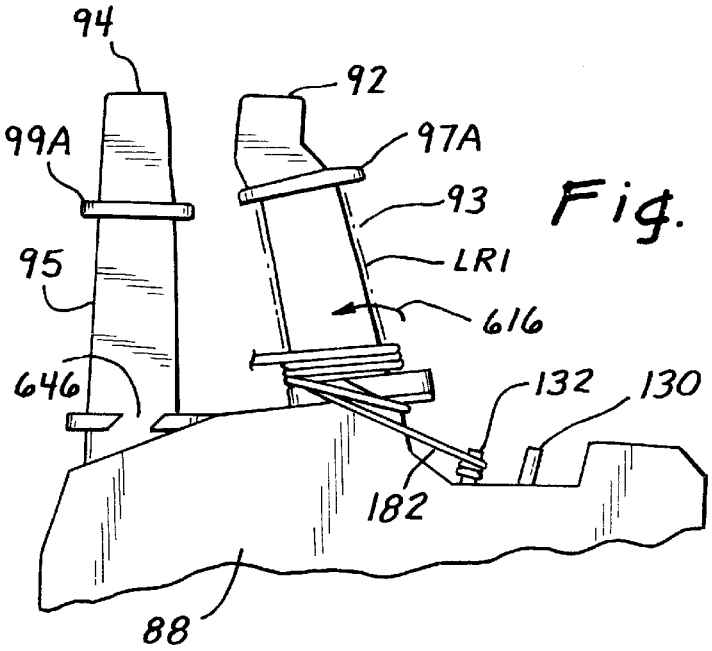
FIG. 19 shows a second winding being applied to the bobbin.
Figure 20:
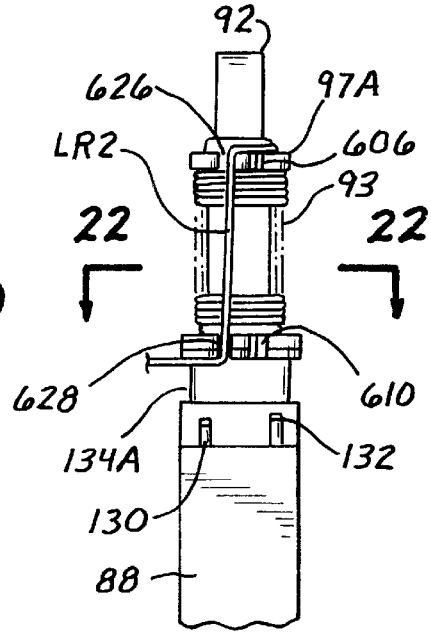
FIG. 20 shows a return of the wire longitudinally in the direction of the bobbin.
Figure 21:
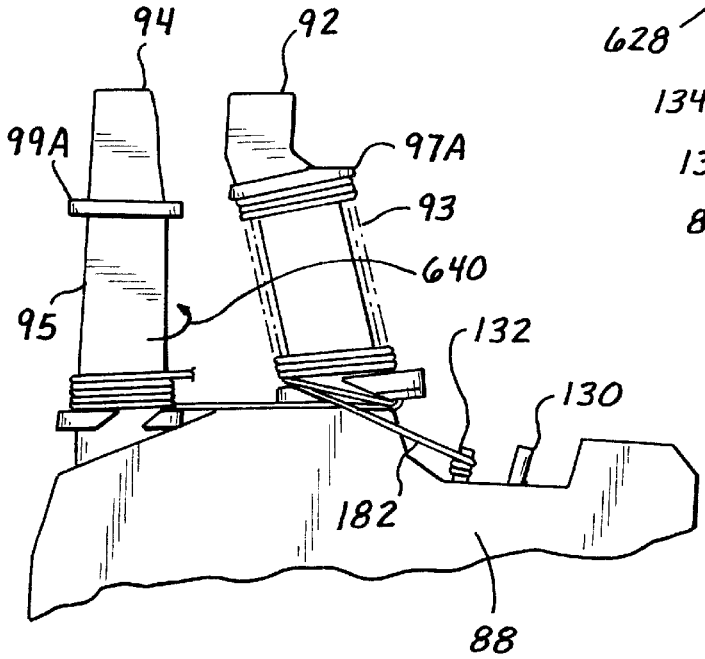
FIG. 21 shows the feed of the wire from one bobbin being fed to another.

This second winding extends in a clockwise wind again toward end flange or stop 97A as seen in FIG. 20 after it has been wound in the clockwise direction in FIG. 19. The second winding when it traverses the interior portion between the two coils and bobbins 97A and 99A wraps around the existing winds and the longitudinal return LR 1. Thus, the thickness or breadth B of the wrap is increased in the area removed from the proximal coil wrapped around bobbin 95 and is wrapped around bobbin 95 in a manner to increase the wind at the exterior portion removed from the space between the two.

The foregoing winding as can be seen with the winding terminating at the end portion or flange 97A is then returned in the direction of longitudinal return LR 2 as seen in FIG. 20. The longitudinal return of LR 2 returns through the end flange 97A that has a slot 626 therein so that the longitudinal return LR 2 can extend backwardly in the area outside of the space between the two bobbins 93 and 95. It then terminates within a second slot 628 of the end flange or base flange 600.

A plurality of windings around the bobbin 93 with the longitudinal returns LR 1 and LR 2 can be increased to extend the number of longitudinal return wraps passing through the respective slots 606, 610, 626, and 628. This creates a multiple number of windings extending from the base flange 600 out to end 97A and making a number of longitudinal returns that can be one, two, or any number depending upon manufacturing capability.

Also, it can be understood that the longitudinal returns LR 1 and LR 2 can traverse along the longitude of the pole piece 92 after the pole piece has been wound in a normal manner with a winding extending outwardly then backwardly in a uniform manner without the longitudinal return. The inventive concept is to increase the number of winds without decreasing the space between the bobbins 93 and 95. Thus, any combination of longitudinal returns or crossovers can be utilized to increase the breadth at a dimension removed from the space between the respective pole pieces 92 and 94.

Also, combinations of the longitudinal return wires LR 1 and LR 2 can also be utilized with crossovers as in the previous embodiment.

After the longitudinal returns LR 1 and LR 2 are effected in the final wraps, the wire 182 is then wound on the bobbin 95 in a counter clockwise manner in the direction of arrow 640. This can be seen clearly in FIG. 21 wherein the wire extends from the first winding to the bobbin 95 and is then wrapped in a counter clockwise direction. At the end of the windings, the wire is then returned through a slot 646 in a slot analogous to the slots 134 as seen by slot or groove 134A in FIGS. 18 and 20 in the side of the bobbin 88 of FIG. 4 so that they can then be terminated on terminal 130.

Further to this extent any combination of slots or windings can take place at the ends of the respective bobbins 93 and 95 such that terminal flange 97A and 99A can provide for returns in different configurations. Also, the slots such as slots 610 and 628 can be such where they accommodate more than one longitudinal return LR of a wire and can be also multiple in number. Thus, any combination of returns can be utilized.

Any variation can be utilized to incorporate the pitch of the width crossovers and the respective breadth. The net result should be the ability to provide for a compact coil relationship to allow such a winding by an analogous instrument as the needle 180 proceeding between the distal and proximal coils. The essence fundamentally is to create a lesser incursion by the coils into the area between the distal and the proximal coils as well as minimizing the width between them for compact relationship of the plurality of coils in a hammerbank along a particular bank. Thus, this invention helps to limit the width as well as placing the breadth of the coils in an orientation to maximize the winding capability hereof.

What is claimed is:

1. A line printer comprising:

a bank of hammers with printing tips mounted on a hammerbank;

a permanent magnet for retaining said hammers;

a pole piece magnetically coupled between said magnet and one of said hammers;

a coil around said pole piece having a spaced winding with a second winding at least partially filling the space; and a bobbin surrounding a portion of said pole piece, wherein said coil is wrapped around said bobbin and said coil formed with said spaced winding is wound so as to increase the breadth of said coil with respect to the width.

2. The line printer of claim 1, wherein said spaced winding is wound with odd numbered pitches with one of said second windings at least partially filling in between said spaced windings.

3. The line printer of claim 1, wherein said spaced winding is wound with even numbered pitches with said second winding at least partially filling in said spaced windings.

4. The line printer of claim 1 further comprising a second pole piece adjacent to said pole piece and a second bobbin surrounding a portion of said second pole piece, wherein said bobbins are formed as pairs on a bobbin frame member that encompasses a portion of said pole pieces.

5. The line printer of claim 1, wherein the spaced winding and the second winding are in opposite directions.

6. The line printer of claim 1, wherein said second winding fills said space.

7. A line printer comprising:

a bank of hammers with printing tips mounted on a hammerbank;

a permanent magnet for retaining said hammers;

a pole piece magnetically coupled between said magnet and one of said hammers; and a coil around said pole piece having a spaced winding with a second winding at least partially filling the space, wherein said winding filling said spaced windings terminates at a terminal connection distal from an end of said pole piece that is proximate to said hammers.

8. A line printer comprising:

a bank of hammers with printing tips mounted on a hammerbank;

a permanent magnet for retaining said hammers;

a pole piece magnetically coupled between said magnet and one of said hammers; and a coil around said pole piece having a spaced winding with a second winding at least partially filling the space, wherein said coil further comprises at least one unspaced winding layer underlying said spaced winding and said second winding.

9. The line printer of claim 8, wherein said spaced winding and said second winding comprise one layer of said coil.

10. The line printer of claim 9, wherein at least one unspaced winding layer and said one layer form an odd number of layers of said coil.

11. A line printer comprising:

a bank of hammers with printing tips mounted on a hammerbank;

a permanent magnet for retaining said hammers;

a pole piece magnetically coupled between said magnet and one of said hammers;

a coil around said pole piece having a spaced winding with a second winding at least partially filling the space;

a bobbin surrounding a portion of said pole piece, wherein said coil is wrapped around said bobbin and said coil formed with said spaced winding is wound so as to increase the breadth of said coil with respect to the width; and a second pole piece adjacent to said pole piece and a second bobbin surrounding a portion of said second pole piece, wherein said bobbins are formed as pairs on a bobbin frame member that encompasses a portion of said pole pieces, wherein the bobbins are formed from a unitary structure.

12. A line printer comprising:

a bank of hammers with printing tips mounted on a hammerbank;

a permanent magnet for retaining said hammers;

a pole piece magnetically coupled between said magnet and one of said hammers;

a coil around said pole piece having a spaced winding with a second winding at least partially filling the space;

a bobbin surrounding a portion of said pole piece, wherein said coil is wrapped around said bobbin and said coil formed with said spaced winding is wound so as to increase the breadth of said coil with respect to the width; and a second pole piece adjacent to said pole piece and a second bobbin surrounding a portion of said second pole piece, wherein said bobbins are formed as pairs on a bobbin frame member that encompasses a portion of said pole pieces, wherein the pole pieces are formed from a unitary structure.

13. A line printer comprising:

a bank of hammers with printing tips mounted on a hammerbank;

a permanent magnet for retaining said hammers;

a pole piece magnetically coupled between said magnet and one of said hammers; and a coil around said pole piece having a spaced winding with a second winding at least partially filling the space, wherein said coil further comprises a wire crossing the spaced winding and the second winding.

14. The line printer of claim 13, wherein said wire is approximately orthogonal to the spaced winding and the second winding.

15. A line printer comprising:

a bank of hammers with printing tips mounted on a hammerbank;

a permanent magnet for retaining said hammers;

a pole piece magnetically coupled between said magnet and one of said hammers;

a coil around said pole piece having a spaced winding with a second winding at least partially filling the space;

a bobbin surrounding a portion of said pole piece, wherein said coil is wrapped around said bobbin and said coil formed with said spaced winding is wound so as to increase the breadth of said coil with respect to the width; and a second pole piece adjacent to said pole piece and a second bobbin surrounding a portion of said second pole piece, wherein said bobbins are formed as pairs on a bobbin frame member that encompasses a portion of said pole pieces, wherein the wire lies along the length of the pole piece opposite of the gap between the two pole pieces.

16. A line printer comprising:

a bank of hammers with printing tips mounted on a hammerbank;

a permanent magnet for retaining said hammers;

a pole piece magnetically coupled between said magnet and one of said hammers;

a coil around said pole piece having a spaced winding with a second winding at least partially filling the space;

a bobbin surrounding a portion of said pole piece, wherein said coil is wrapped around said bobbin and said coil formed with said spaced winding is wound so as to increase the breadth of said coil with respect to the width; and a second pole piece adjacent to said pole piece and a second bobbin surrounding a portion of said second pole piece, wherein said bobbins are formed as pairs on a bobbin frame member that encompasses a portion of said pole pieces, wherein the width of the pole pieces is less than the breadth of the pole pieces.

* * * * *